US007942390B2

(12) United States Patent
Menassa

(10) Patent No.: US 7,942,390 B2
(45) Date of Patent: May 17, 2011

(54) STEAM HUMIDIFIER

(75) Inventor: Cherif Menassa, Kirkland (CA)

(73) Assignee: Thermolec LTEE, Montréal, Québec (CA)

( * ) Notice: Subject to any disclaimer, the term of this patent is extended or adjusted under 35 U.S.C. 154(b) by 1049 days.

(21) Appl. No.: 11/797,237

(22) Filed: May 2, 2007

(65) Prior Publication Data

US 2007/0257386 A1 Nov. 8, 2007

Related U.S. Application Data

(60) Provisional application No. 60/796,880, filed on May 3, 2006.

(51) Int. Cl.
*B01F 3/04* (2006.01)

(52) U.S. Cl. ..... 261/131; 261/137; 261/66; 261/91; 261/DIG. 10

(58) Field of Classification Search ..... 261/66, 261/84, 91, 119.1, 130, 131, 137, 142, DIG. 10, 261/DIG. 15, DIG. 65, DIG. 76
See application file for complete search history.

(56) References Cited

U.S. PATENT DOCUMENTS

| | | | | | |
|---|---|---|---|---|---|
| 2,454,657 | A * | 11/1948 | Kuzmin et al. | ..... | 392/406 |
| 3,714,392 | A * | 1/1973 | Katzman et al. | ..... | 392/337 |
| 3,809,374 | A * | 5/1974 | Schossow | ..... | 261/130 |
| 3,873,806 | A * | 3/1975 | Schossow | ..... | 392/402 |
| 4,132,883 | A * | 1/1979 | Grime | ..... | 392/337 |
| 4,463,248 | A * | 7/1984 | Katzman et al. | ..... | 392/337 |
| 5,516,466 | A | 5/1996 | Schlesch et al. | | |
| 5,855,823 | A | 1/1999 | MacGibbon et al. | | |
| 5,971,369 | A * | 10/1999 | Neveu et al. | ..... | 261/91 |
| 6,427,637 | B1 * | 8/2002 | Ineichen | ..... | 122/6 A |
| 6,631,856 | B2 | 10/2003 | Herr | | |
| 7,011,300 | B2 * | 3/2006 | Kopel et al. | ..... | 261/141 |

* cited by examiner

*Primary Examiner* — Scott Bushey
(74) *Attorney, Agent, or Firm* — Equinox Protection; Franz Bonsang

(57) ABSTRACT

A steam humidifier provided by the present invention has a tank having a reservoir section and a cover removably and sealingly secured thereto. The tank contains water during a humidifying operation in which the humidifier humidifies an indoor environment. The cover has a heating element mounted thereon and extending therefrom into the reservoir section and a steam outlet assembly mounted thereon and extending therethrough into the tank. The heating element evaporates at least a portion of the water during the humidifying operation into steam output through the steam outlet assembly to humidify the indoor environment.

27 Claims, 5 Drawing Sheets

STEAM HUMIDIFIER

CROSS REFERENCE TO RELATED APPLICATION

Benefit of U.S. Provisional Application for Patent Ser. No. 60/796,880, filed on May 3, 2006, is hereby claimed.

FIELD OF THE INVENTION

The present invention relates to humidifiers and more specifically to steam humidifiers typically connected to a building furnace air duct system, or the like.

BACKGROUND OF THE INVENTION

It is well know to have steam humidifiers that boil water and let the generated steam reach the building furnace air duct system to humidify the air flowing therein. However, these humidifiers suffer numerous drawbacks related to their mode of operation, the regular maintenance or even the repair thereof whenever required.

In fact, during normal operation, these existing steam humidifiers or steamers keep their water reservoir filled with water when they are turned off such that all the non-evaporating particles of limestone or the like accumulate or get deposited on the inner walls thereof as well as on the heating element, especially when the water gets cooler. After a predetermined period of time of operation (which typically depends on the water purity), one needs to either clean-up the inside of the reservoir or simply to replace that reservoir, or at least the bottom section thereof. The removal of the reservoir for such maintenance operation requires the person, typically a specialized technician, to disconnect few electrical wires with temporary removal of main electrical components and/or steam diffuser connection and/or the water drain running through the removable section (generally bottom section) of the reservoir, and the reconnection thereof upon reinstallation of the cleaned or new reservoir.

Furthermore, in the case the water is drained out just before shut down of the humidifier, the amount of water left after drainage is not negligible thus allowing fair amount of particle deposition at the bottom of the reservoir.

Accordingly, there is a need for an improved steam humidifier.

SUMMARY OF THE INVENTION

It is therefore a general object of the present invention to provide an improved steam humidifier.

An advantage of the present invention is that particle deposits in the steam humidifier are reduced, with most particles being automatically drained therefrom.

Another advantage of the present invention is that the steam humidifier provided thereby requires little maintenance.

Still another advantage of the present invention is that the steam humidifier provided thereby is easily disassembled, by removing the bottom of the water tank, free of operating component connection, from its top cover.

Another advantage of the present invention is that the steam humidifier is periodically self-cleaning.

A further advantage of the present invention is that the steam humidifier has all its operating components connected to a single element, typically the top cover, of a water tank therefore, the remaining portion of the water tank being thereby easily removable.

Still another advantage of the present invention is that the steam humidifier nearly empties the water tank at the end of humidifying operation to eliminate most of the particulates accumulating into the water and to enable the following restart with as mush fresh water as possible.

According to an aspect of the present invention a first aspect of the present invention there is provided a steam humidifier comprising a tank having a reservoir section and a cover removably and sealingly secured thereto, the tank containing water during a humidifying operation in which the humidifier humidifies an indoor environment, the cover having a heating element mounted thereon and extending therefrom into the reservoir section and a steam outlet assembly mounted thereon and extending therethrough into the tank, the heating element evaporating at least a portion of the water during the humidifying operation into steam output through the steam outlet assembly to humidify the indoor environment.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

Figure 1:
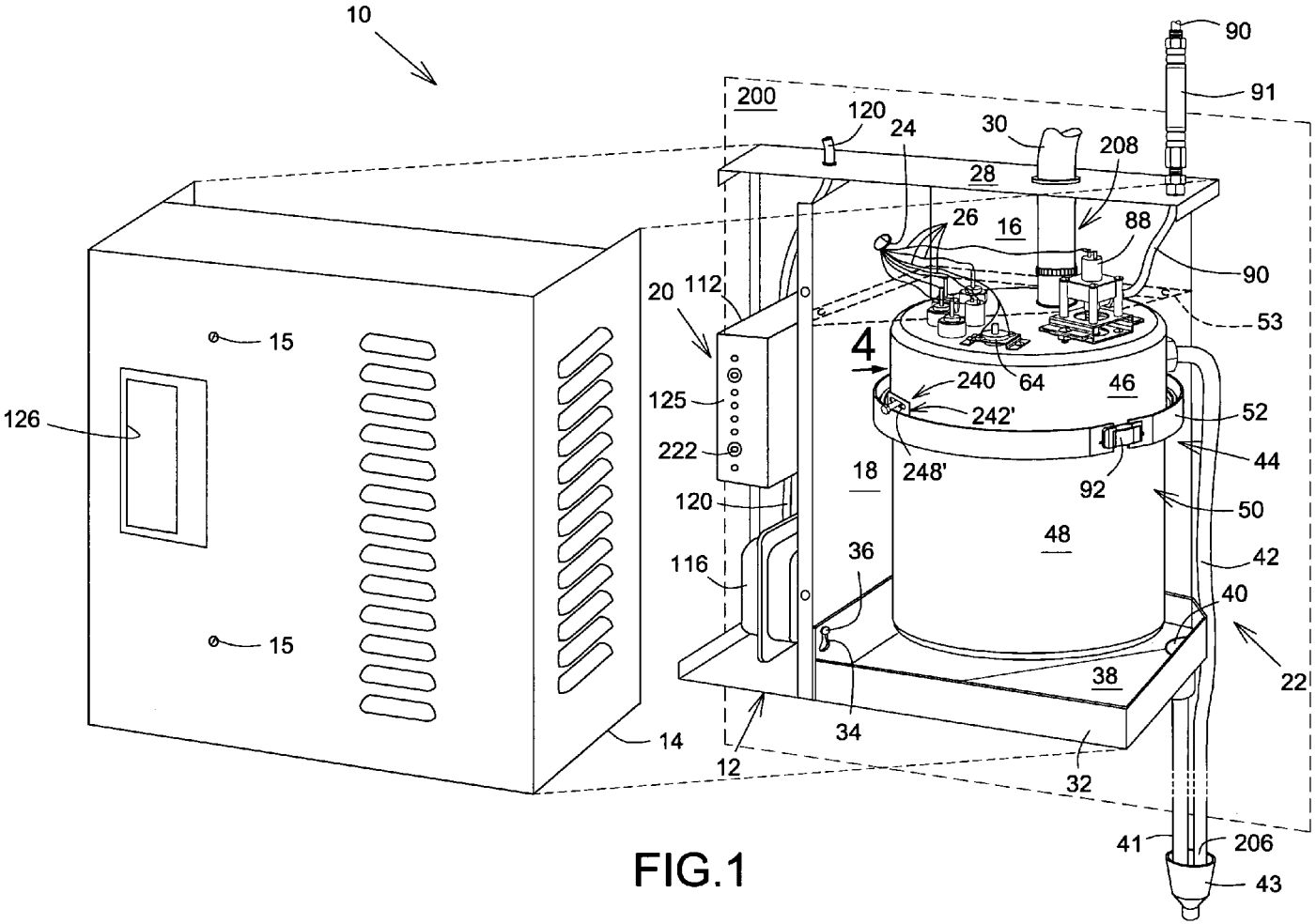
FIG. 1 is a simplified exploded top perspective view of a steamer humidifier in accordance with an embodiment of the present invention, showing the front cover detached from housing.
Figure 2:
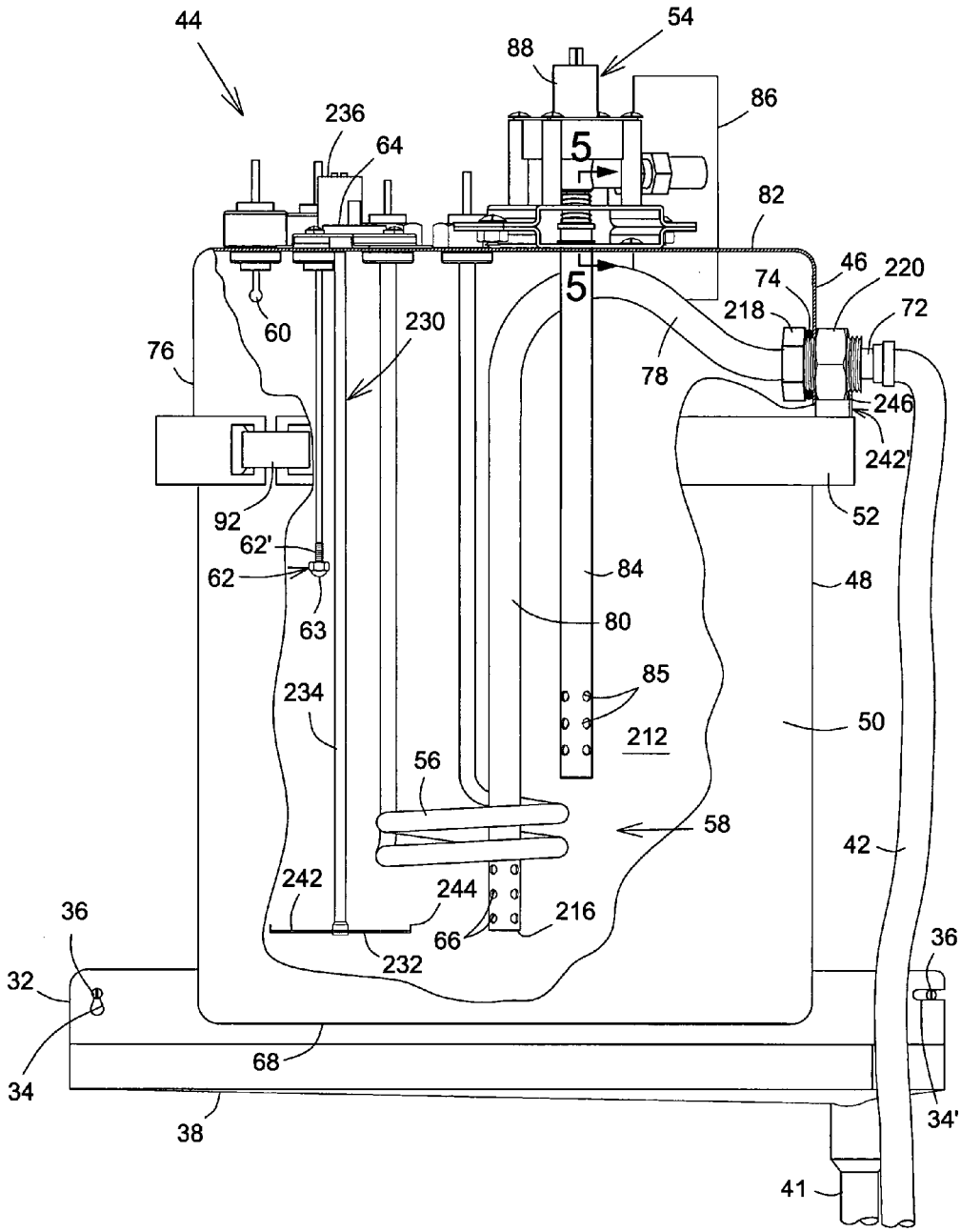
FIG. 2 is a simplified enlarged side view of the tank of the embodiment of FIG. 1, showing the inside of the reservoir, the latter being in dotted lines for clarity purposes.
Figure 5:
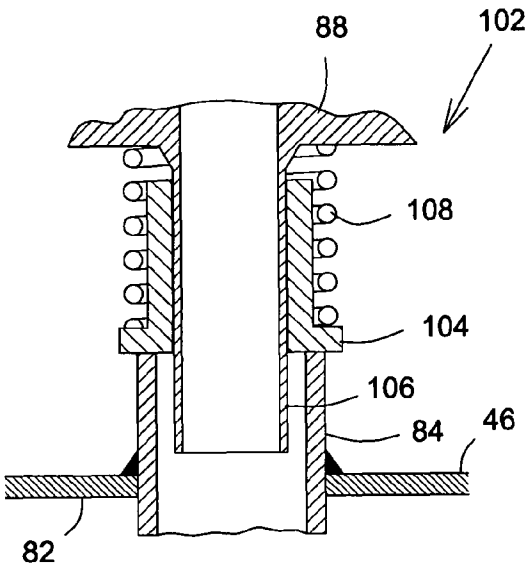
Figure 4A:
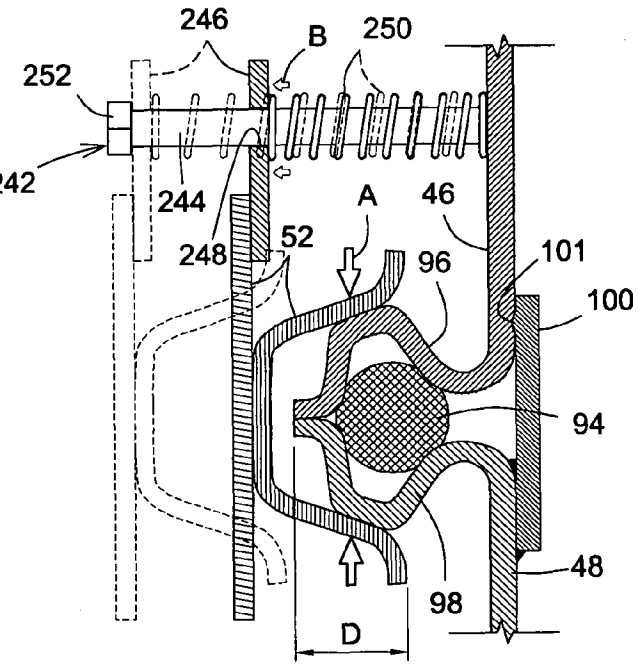
FIG. 4 is a simplified enlarged broken perspective view taken along line 4 of FIG. 2.
Figure 4:
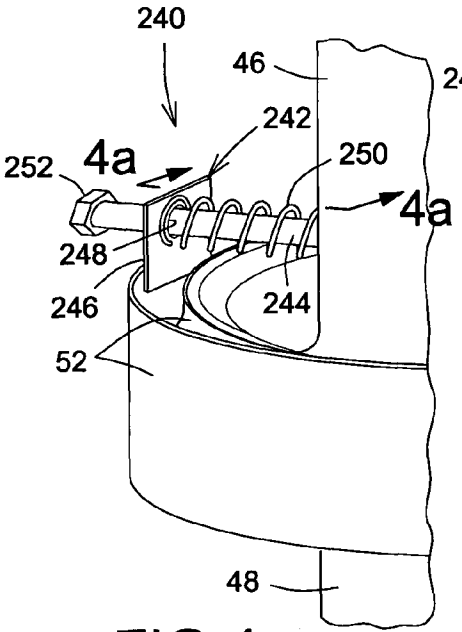
Figure 6:
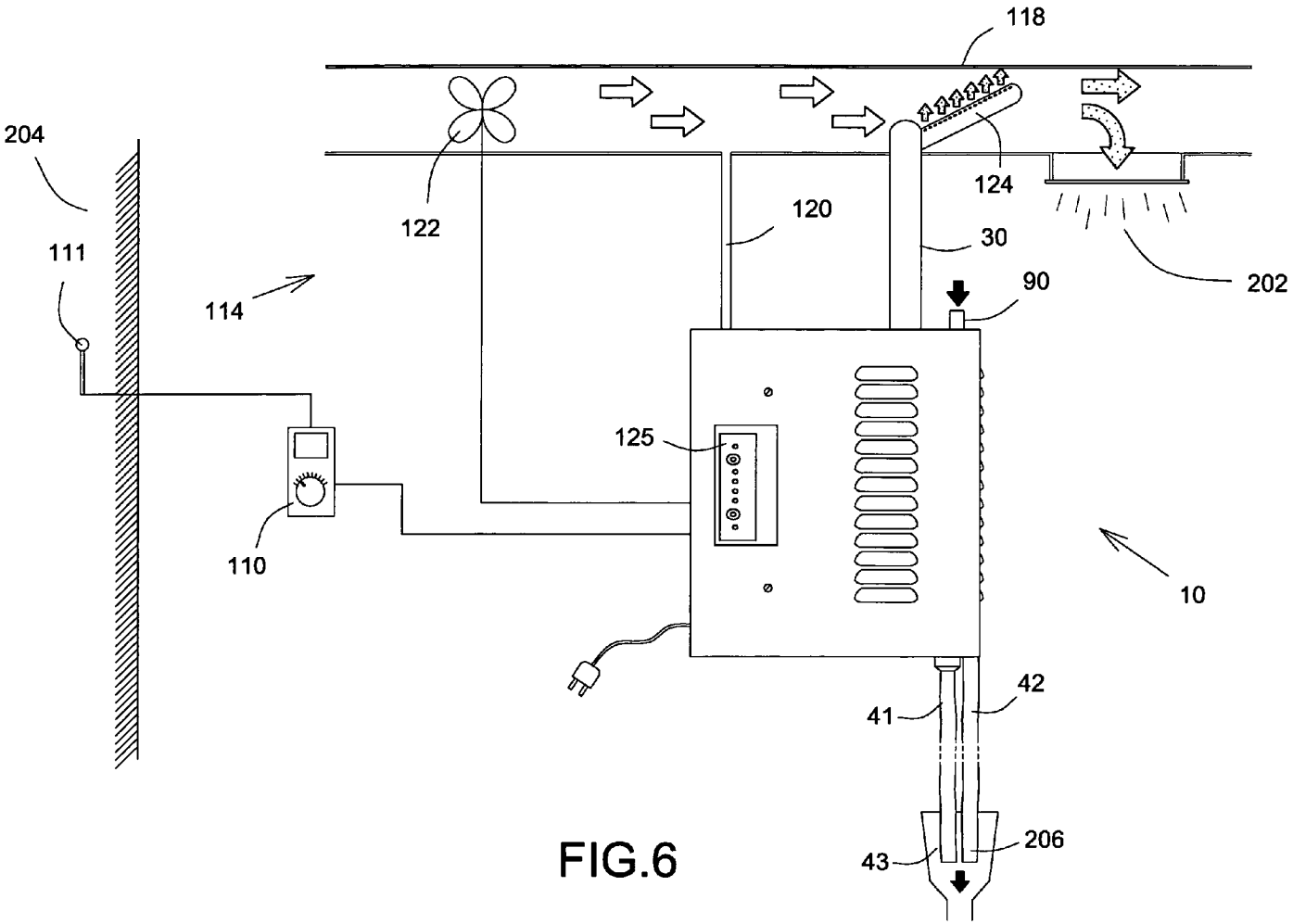

FIG. **4*a* is a simplified broken section view taken along line 4*a*-4*a* of FIG. 4**;

FIG. 5 is a simplified broken section view taken along line 5-5 of FIG. 2; and FIG. 6 is a schematic front view of the embodiment of FIG. 1 in operating connection with the building furnace air duct system.

DETAILED DESCRIPTION OF THE PREFERRED EMBODIMENT

With reference to the annexed drawings a preferred embodiment of the present invention will be herein described for indicative purpose and by no means as of limitation.

Referring first to FIG. 1 there is shown a steam humidifier, shown generally as 10, in accordance with an embodiment of the present invention, with the removable front cover 14 detached from the housing 12 generally mounted on a wall 200 of a building. The cover 14 is releasably secured to the housing 12 via quarter-turn captive mounting screws 15 or the like. The housing 12 typically includes a rear mounting wall 16, a vertical separating wall 18 extending from the rear mounting wall 16 and which separates the control and power side 20 from the steamer side 22 with an access opening 24 extending there through for access to the different electrical wires 26. The housing 12 also includes a rear top wall 28 through which the steam pipe 30 extends. On the steamer side 22, the removable bottom pan 32 has conventional mounting vertical slot hole 34 and horizontal slot opening 34' being engageable by respective screws 36, rivets or the like protrusions, mounted on the separating wall 18. Although not shown, the pan 32 could also be similarly mounted on the rear mounting wall 16. The pan 32 typically has a sloping floor wall 38, which slopes downwardly from the separating wall 18 when the pan 32 is connected thereto, and which directs any water eventually falling into the pan 32 toward a drainage opening 40 connected to a pan drain pipe 41 having its downstream end typically freely connecting to a water drain, schematically illustrated by reference 43, for disposal of water. The water drain 43 is further adapted to freely receive the outlet end 206 of the typically flexible water exhaust pipe 42 therein without preventing water from the pan drain pipe 41 to simultaneously get through the water drain 43, as shown in FIG. 2. Typically, the water exhaust pipe 42 runs downwardly along the tank 50 and out of the housing 12 through an opening formed by a cutout corner section 33 of the pan 32.

Figure 3:
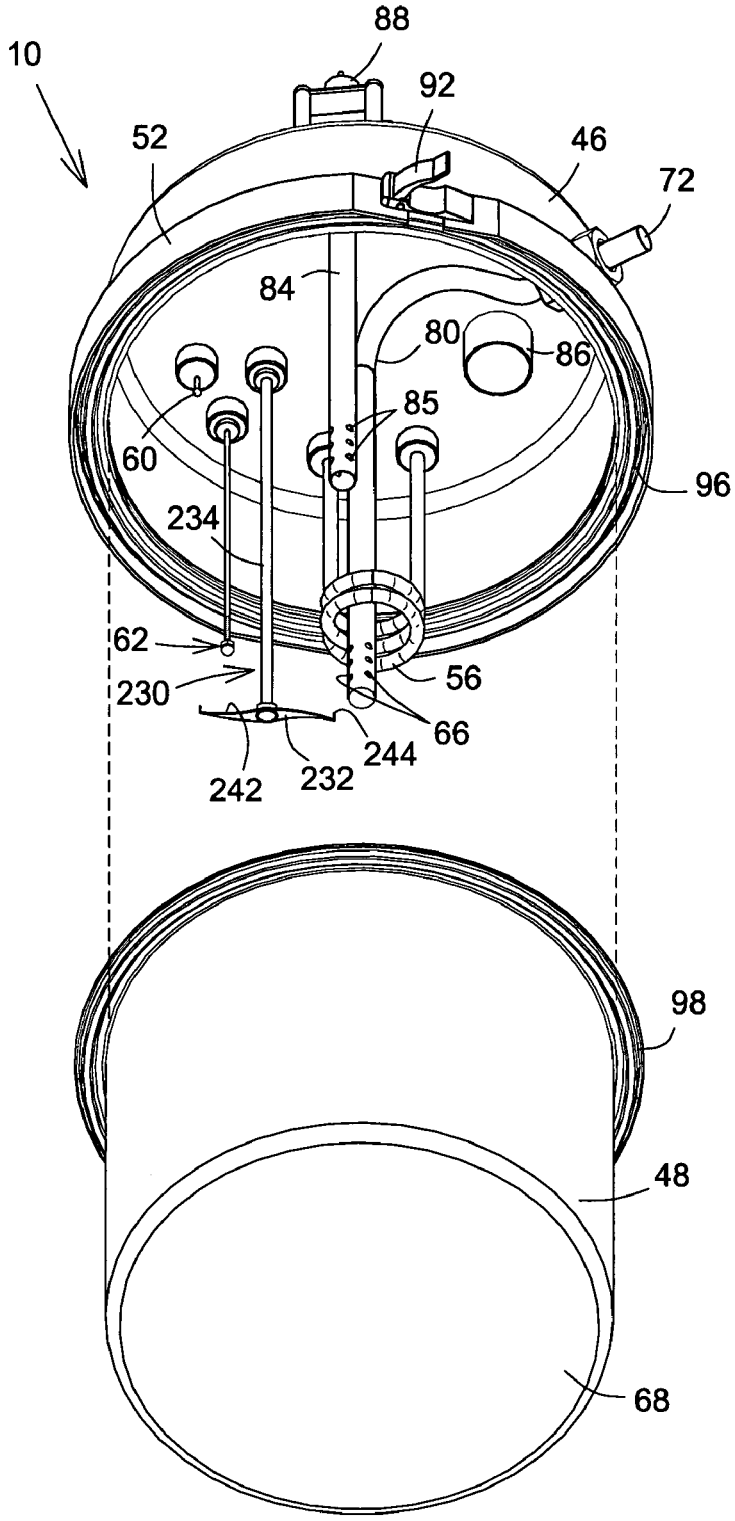
FIG. 3 is a simplified exploded bottom perspective view of the tank of the embodiment of FIG. 1.

Now referring more specifically to FIGS. 2 and 3, there is shown the steamer assembly 44 located on the steamer side 22, with the top cover section 46 and the bottom reservoir section 48 of the water tank 50 releasably and sealably connected to one another by a circular flange V-clamp 52 all shown broken in FIG. 2 to better illustrate the inside thereof. The cover 46 is typically secured to the housing 12 via a tank holder 53 attached thereto and shown in dotted lines in FIG. 1 for clarity purposes. The assembly 44 includes a water inlet assembly 54, a steam outlet assembly 208, a heating element 56, a siphon drain assembly 58, first 60 and second 62 water level sensors, and a thermal cut-out switch 64 all mounted on the cover 46. Accordingly, the bottom reservoir section 48 is free to be detached from the cover 46 when the clamp 52 is released, as shown in FIG. 3, as long as the pan 32 has previously been removed from the housing 12. Generally speaking, the reservoir section 48 has a reservoir floor 68 from which one or more reservoir walls 212 extend vertically upwardly away therefrom, the reservoir floor 68 and reservoir walls 212 generally defining the reservoir section 48.

The siphon drain assembly 58 includes a water exhaust pipe 42, which forms part of an outlet section 72 of the siphon drain assembly 58, and an internal drain pipe 80 connected thereto through the cover 46 of the tank 50. Typically, the siphon drain assembly 58 allows drainage of a sufficient amount of water from the tank 50 to eliminate most of the solid particles in suspension into the water when the humidifier is in standby non-operation state to ensure that the following restart occurs with as much fresh water as possible. Accordingly, water intake openings 66, of reasonable size to allow small particles in suspension into the water to flow there through, of the siphon drain assembly 58 are typically located below the heating element 56 adjacent the bottom of the reservoir floor 68 of the reservoir section 48, as shown in FIG. 2. The outlet section 72 of the siphon drain assembly 58 is typically releasably and sealably (via an O-ring seal 74) connected to the side wall 76 of cover 46 such that the siphon drain assembly 58 can eventually be easily replaced because of possible particle depositions thereon after extensive use in draining water full of particles there through. More specifically, the water exhaust pipe 42 extends, from a threaded connection end 220 thereof, connected to side wall 76 of cover 46, outside of the tank 50 to an outlet end 206 of the water exhaust pipe 42, the connection end 220 preferably extending through the side wall 76 into the tank 50. The internal drain pipe 80 extends from the side wall and has an O-ring seal 74 mounted on a respective drain pipe threaded first end 216, and the water intake openings 66 on a respective drain pipe second end 218 thereof (the axial end 218 of the internal drain pipe 80 is typically closed off to prevent insertion of large particles in suspension in the water therein that could eventually at least partially obstruct the pipe thus affecting the draining efficiency thereof). The first end 216 of the internal drain pipe 80 and the connection end 220 of the exhaust pipe 42, being threaded, are releasably connected to one another through the side wall 76 with the O-ring 74 sealingly abutting the side wall 76 inside the tank 50. Thus, the internal drain pipe 80 is sealingly connected to the side wall 76 within the tank 50 and to the exhaust pipe 42. Alternatively, although not shown, the outlet section 72 could be integral with the internal drain pipe 80 and be welded to an opening of the cover side wall 76. Accordingly, water may be received from the water drainage openings 66 during siphoning thereof and siphoned through the internal drain pipe 80 into the water exhaust pipe 42 and carried by the siphoning to the outlet end 206 for disposal in the water drain 43 for disposal thereof. To ensure sufficient siphoning action at all time, the outlet end 206 and the water drain 43 are typically positioned at least about 12 inches (30 cm) below the reservoir floor 68 of the tank or the pan 32 level.

The outlet section 72 is connected to side wall 76 since it needs to be below the highest curved section 78 of the typically rigid internal drain pipe 80 to allow water siphoning to occur whenever required. The top wall 82 of cover 46 has water inlet opening and steam outlet opening with respective water inlet pipe 84 and steam outlet pipe 86 extending there through and sealably secured thereto with welding or the like. The water inlet assembly 54 includes a water inlet pipe 84, a solenoid valve 88 or the like, and a flexible water inlet hose 90. The water inlet pipe 84, having water inlet openings 85 at the internal opening thereof, is connected to the water source typically via the controlled solenoid valve 88, which is connected to the controller 112 and to a flexible water inlet hose 90, the flexible inlet hose 90 being directly connected to the water source. At the end region of the water hose 90 close to the valve 88, a water hammer absorber 91, also part of the water inlet assembly 54, is typically provided to attenuate any pressure shock waves generated by the instant closings of the valve 88. The steam outlet assembly, shown generally as 208, includes the steam outlet pipe 86 and the flexible steam pipe 30, to which the steam outlet pipe 86 is typically directly connected. The first and second water level sensors 60, 62, mounted on the cover 46 and extending into the tank 50 are respectively used to detect draining and minimum refill water levels to ensure, respectively, and are connected to controller 112. The normal minimum water level when refill is required is typically below the seal line between the cover 46 and reservoir section 48 of the tank 50. The first water level sensor 60, situated at the draining water level, is positioned in the tank 50 at an elevation at least substantially to the highest curved section 78, i.e. the part of the siphon drain assembly 58 having the highest elevation and thereby at which water is automatically drained by siphoning through the siphon drain assembly 58. The second water level sensor 62 is used to control the water level in the tank 50 during boiling operation of the steamer assembly 44. Because the second water level sensor 62 is much more solicited than the first one, its sensing tip is typically removable to allow its cleaning and/or replacement maintenance due to degradation over time. Accordingly, the tip of the second water level sensor 62 is typically formed of a plated nut cap 63 or the like screwably mounting on an internal threaded end portion of the second sensor stem 62'.

The clamp 52 is typically permanently movably attached to the cover 46 via a clamp mounting assembly 240, as shown in FIGS. 2, 3 and 4, to allow rapid release and tightening thereof via lever 92. The clamp mounting assembly 240 allows the clamp 52 to at least radially move relative to the cover 46, and typically includes a main clamp attachment 242 positioned typically diametrically opposite the lever 92, and preferably secondary clamp attachments 242' located typically halfway between the main attachment 242 and the lever 92. As shown in FIG. 4*a* and illustrated by the arrows A, the V-clamp 52 squeezes an O-ring 94, between the cover and reservoir flanges 96, 98 extending respectively outwardly around the cover 46 and reservoir section 48, upon tightening. The O-ring 94 is typically, but not compulsorily, carried by the reservoir section 48 in the reservoir flange 98. Thus, the V-clamp 52 securely holds the flanges 96, 98 in proximity to one another with the O-ring 94 sealingly disposed therebetween, thereby sealingly and removably connecting the cover 46 and reservoir section 48, when the V-clamp 52 is tightened with the lever 92. The reservoir section 48 is removable when the V-clamp 52 is released, i.e. untightened, using lever 92. In order to allow the reservoir section 48 to remain partially secured to the cover 46 when the clamp 52 is released, until a force is applied thereon, the reservoir section 48 typically has its free edge 100 with a plurality (at least two opposite) dimples 101 protruding radially outwardly which frictionally and abuttingly engage the edge of the inner face the opening of the cover 46.

As shown in FIG. 4, a region hidden in FIGS. 1 through 3, the main clamp attachment 242 typically includes a pin 244 or the like member secured to the cover 46 and extending radially (all references being made relative to the axis of the tank 50) outwardly therefrom that radially slidably engages a through bore 248 of a plate 246 extending axially and circumferentially (or tangentially) from the clamp 52. A biasing means, such as compressive coil spring 250 or the like member located around the pin 244, between the cover 46 and the plate 246, typically urges or biases the plate 246 and the clamp 52 away from the cover 46, in direction B of FIG. 4*a*. A plate stopper 252, such as a pin head or the like, locally limits the outward radial displacement of the plate 246 and clamp 52 relative to the cover 46, under the force of the coil spring 250, by a distance sufficient to allow the clamp 52 to clear the contained radial protrusion D of the reservoir flange 98 thus the vertical removal of the reservoir section 48 from the cover 46, in the released configuration of the clamp relative to the tightened configuration, shown in dotted and solid lines respectively in FIG. 4*a*. Similarly, the secondary clamp attachments 242' includes a circumferential slotted through hole 248' to radially and circumferentially (or tangentially) slidably receive the corresponding pin 244 there through for proper local displacement of the clamp 52 between the released and tightened configurations.

FIG. 5 illustrates an overflow valve 102, also part of the water inlet assembly 54, that prevents water to get back into the inlet valve 88 in case of water back flow under pressure or the like, while closing off the radial gap between the water inlet pipe 84 and the inlet valve 88 against possible particle insertion into the tank 50. The overflow valve 102 includes an inlet pipe plug 104 slidably and sealably mounted on the inlet valve outlet 106 and maintained in abutment against the external opening of the water inlet pipe 84 by a compressive spring 108. Upon high water back pressure occurring inside the water pipe 84, the pressure pushes the plug 104 upwardly along the valve outlet 106 against the spring force to let water, notably any excess portion thereof, escape through the axial opening created between the plug 104 and the water pipe 84.

To reduce deposits of solid particles from water, which are often left in tank 50 after evaporation of the water, the assembly 44 of steam humidifier 10 preferably includes a motorized rotor blade assembly 230, also mounted on the cover 46 and which extends into tank 50. The motorized blade assembly 50 has a motor 236 mounted on the cover 46 and connected to the controller 12, as well as at least one rotor blade 232 disposed within, i.e. extending into, the tank 50, preferably in the reservoir section 48 in proximity to the reservoir floor 68. The rotor blade 232 is also connected to motor 236, by an axle 234 connected to the motor 236 and blade 232 and upon which the blade 232 is rotatable thereby, when the motor 236 is actuated by the controller 112. The rotor blade 232, when rotated by the motor 58, cuts solid particles in the water into smaller particles which may freely pass through the siphon drain assembly 58. The blades 232 preferably have sharpened edges 242, preferably disposed perpendicular to the axle 234, for facilitating cutting of the particles, as well as optional blade protrusions protruding away radially therefrom, preferably in axial alignment with the axle 234. The motor 236 may be actuated by controller 112 during evaporation of the water to immediately break up any particles deposited with blades 232. Additionally, the motor 236 may be actuated whenever the controller 112 initiates siphon draining by enabling passage of water through the water inlet assembly 54 until the draining water level is attained, i.e. detected by first water level sensor 60. In this case, the motor 236 may keep the motor actuated 236 during the process of filling the tank 50 to the draining water level to cut the particles as the tank 50 is filled, disabling the motor 236 once the water is at the draining water level and siphoning through the siphoning assembly 58 commences or when the siphoning is complete. Alternatively, the controller 112 may be configured to actuate the motor 236 only when the water reaches the first water level, i.e. when siphoning through the siphoning assembly 58 commences.

In operation, as schematically illustrated in FIG. 6, when a humidity sensor 110 situated in the indoor environment 202 and operatively connected to the controller 112 (see FIG. 1) of the humidifier detects a low humidity level inside an indoor environment 202, such as a building, to be humidified thereby, the controller 112 starts humidifying operation of the humidifier 10 during which the indoor environment 202 is humidified. In order to adjust the comfortable inside humidity level depending on the outdoor temperature to prevent water condensation in building windows during cold outdoor weather condition, the humidity sensor typically includes an outdoor temperature sensor 111 connected thereto which senses the temperature of an outdoor environment 204 generally adjacent the indoor environment 202. Typically, when the steam humidifier 10 is used in conjunction with a building intermittent ventilation system, the controller 112 first sends a turn-on command to the fan 122 of the building furnace air duct system 114 to ensure it is operating and then detects if air is flowing through the system 114 or the like via a vacuum detector 116 (see FIG. 1) connected to the air duct 118 via an air pressure hose 120. In the case the system 114 is a continuously operating ventilation system, the turn-on command is simply ignored. Upon presence of air flow, the controller 112 opens the inlet valve 88, thereby enabling passage of water through the water inlet assembly 54, and lets water fill the tank 50 until a predetermined amount of time lapses after the second water level sensor 62 detects water has reached its minimum level. After the pre-determined period of time, the passage of the water through the water inlet assembly 54 is disabled by closure of the valve 88 by the controller 112. The predetermined amount of time typically ensures that a sufficient amount of water, such as a boiling level typically around the seal line between the cover 46 and reservoir section 48 of the tank 50, that may slightly vary from time-to-time without affecting operation of the humidifier, enters the tank 50 for proper operation of the humidifier, and usually considers a water supply pressure average. Then the heater element 56 is actuated by the controller 112 to evaporate, i.e. boil, water and generate steam that will flow into the air duct via the steam pipe 30, having a steam diffuser 124 at the end thereof, to humidify the air inside the indoor environment 202. When comfortable humidity level is detected by the humidity sensor 110, the controller 112 removes power, i.e. deactuates the heater element 56 and opens the inlet valve 88, again enabling passage of water through the water inlet assembly 54, until the first water level sensor 60 detects water, meaning that siphoning is about to start through the siphon drain assembly 58, and slightly beyond to ensure draining has started, and then closes valve 88 to stop operation of the humidifier 10. Typically, the components of the siphon drain assembly 58 are sized to provide a draining flowrate larger than the filling flowrate to always ensure proper drainage of water even though there would be a malfunctioning of the inlet valve 88 (in which case the controller 112 should detect the unusual opening state of the inlet valve 88 in the absence of water detection from the first water level sensor 60). Since the outlet end 206 of the water exhaust pipe 42 is below the floor wall 68 of the reservoir section 48, essentially all the water inside the tank 50 is drained out until air enters the siphon intake openings 66. The controller 112 may actuate the motor 236, and thereby the blades 232, either during filling of the tank 50 for humidifying, and during humidifying, or during filling of the tank 50 for drainage and during draining of the tank 50, as described above.

Obviously, during operation of the humidifier 10, when the second water level sensor 62 stops detecting water (meaning that the water level is below its minimum required level), the controller reopens the inlet valve 88 for the above pre-determined amount of time until proper boiling level is essentially reached.

Although the humidifier 10 could be programmed to perform self-cleaning water drainage after a predetermined amount of minutes of continuous operation, an operator can always stop normal operation of the humidifier and force for a water drainage to be performed simply by pressing a predetermined button 222 on the controller display interface 125 accessible via a display opening 126 (see FIG. 1) of the front panel cover 14. When the pre-determined button 222 is pushed, the controller 112 enables passage, by siphoning, of water through the siphon drain assembly 58, by enabling flow of water through the water inlet assembly 54 until first water level sensor 60 detects water at the draining water level. The controller 112 then disables flow of water through the water inlet assembly 54 and the water is drained from the tank 50 by siphoning through the siphon drain assembly 58.

Whenever maintenance is required, the operator simply needs to ensure that water is drained out from the tank 50 before disconnecting power from the humidifier 10. Then, the front cover 14 is removed from the housing 12 via mounting screws 15, followed by the bottom pan 32. Then, the clamp 52 is released to allow the reservoir section 48 to be detached from the cover 46 and removed downwardly for easy maintenance of any part or component of the humidifier 10. The reverse sequence needs to be performed before reactivation of the humidifier 10.

Although the present invention has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A steam humidifier comprising:

a tank having a reservoir section and a cover removably and sealingly secured thereto, said tank containing water during a humidifying operation in which the humidifier humidifies an indoor environment, said cover having a heating element mounted thereon and extending therefrom into said reservoir section and a steam outlet assembly mounted thereon and extending therethrough into said tank, said heating element evaporating at least a portion of said water during said humidifying operation into steam output through said steam outlet assembly to humidify said indoor environment; and a water inlet assembly mounted on said cover, said water inlet assembly being connectable to a water source and configured for passage of said water from said water source therethrough into said tank.

2. The steam humidifier of claim 1, further comprising a housing within which said tank is housed, said cover being secured to said housing.

3. The steam humidifier of claim 1, further comprising a V-clamp movably secured to a cover flange extending outwardly around said cover from a side wall thereof, said V-clamp releasably securely holding a reservoir flange extending outwardly around said reservoir section in proximity to said cover flange, thereby connecting said cover and said reservoir section, when said V-clamp is tightened around said reservoir flange and said cover flange, said reservoir section being removable from said cover when said V-clamp is untightened.

4. The steam humidifier of claim 1, further comprising a controller connected to said heating element, said controller actuating said heating element during said humidifying operation for evaporating said water and deactuating said heating element to stop said humidifying operation.

5. The steam humidifier of claim 4, further comprising a siphon drain assembly mounted on said cover and extending into said tank for siphoning said water out of said tank when said humidifying operation is terminated.

6. A steam humidifier comprising a tank having a reservoir section and a cover removably and sealingly secured thereto, said tank containing water during a humidifying operation in which the humidifier humidifies an indoor environment, said cover having a heating element mounted thereon and extending therefrom into said reservoir section and a steam outlet assembly mounted thereon and extending therethrough into said tank, said heating element evaporating at least a portion of said water during said humidifying operation into steam output through said steam outlet assembly to humidify said indoor environment, a motorized rotor blade assembly having at least one rotor blade extending into said tank and a motor mounted on said cover, each rotor blade being connected to said motor and rotatable thereby, said rotor blade, when rotated by said motor, cutting solid particles in said water into smaller particles passable with said water through a siphon drain assembly mounted on said cover.

7. The steam humidifier of claim 5, further comprising a first water level sensor mounted on said cover and extending therefrom into said tank, said first water level sensor sensing said water when a water level thereof in said tank is at a draining water level at least substantially equal in elevation to a highest portion of said siphon drain assembly having maximum elevation thereof and, thereby, at which said water is automatically drained by siphoning through said siphon drain assembly.

8. The steam humidifier of claim 7, further comprising a second water level sensor mounted on said cover and extending therefrom said cover into said tank below said cover, said second water level sensor sensing said water when said water level is equal to a predetermined minimum level.

9. The steam humidifier of claim 8, further comprising a humidity sensor connected to said controller and situated in said indoor environment, said humidity sensor sensing a respective humidity level of said air in said indoor environment, said controller actuating said heating element when said humidity level is below a pre-determined minimum humidity level and deactuating said heating element when said humidity is at least equal to a predetermined comfortable humidity level.

10. The steam humidifier of claim 9, wherein said controller is further connected to said water inlet assembly and to said second water sensor, said controller initially enabling said passage of said water through said water inlet assembly, when said humidity sensor senses that said respective humidity level is below said minimum humidity level and prior to actuating said heating element, said controller disabling said passage after a pre-determined period of time once said first water sensor senses said water level is at said minimum water level.

11. The steam humidifier of claim 9, wherein said controller is connected to said inlet assembly and to said first water sensor, said controller enabling said passage of said water through said water inlet assembly when said humidity sensor senses that said respective humidity level is at said comfortable humidity level until said first water sensor senses that said water is at said draining water level, thereby causing said water to be drained through said siphon drain assembly.

12. The steam humidifier of claim 10, said controller, while said heating element is actuated, re-enabling said passage of said water through said water inlet assembly whenever said first water sensor stops sensing said water, said controller disabling said passage after a pre-determined period of time once said first water sensor senses that said water level is at said minimum water level.

13. The steam humidifier of claim 7, wherein said controller is connected to a controller display interface, said controller enabling said passage of said water through said water inlet assembly when a user pushes a pre-determined button on said interface, said controller disabling said passage once said first water sensor senses said water level is at said draining water level, thereby allowing said water to be drained from said tank through said siphon drain assembly.

14. The steam humidifier of claim 9, further comprising a vacuum detector connected to said controller and situated in an air duct of a ventilation system for said indoor environment, an air flow in said air duct being detectable by said vacuum detector, said controller actuating said vacuum sensor when said humidity sensor senses that said humidity level is below said minimum humidity level, said controller verifying that said air flow is detected by said vacuum sensor prior to actuating said heating element.

15. The steam humidifier of claim 9, further comprising an outdoor temperature sensor connected to said humidity sensor, said outdoor temperature sensor sensing a temperature in an outdoor environment adjacent to said indoor environment.

16. The steam humidifier of claim 4, wherein said water inlet assembly comprises a water inlet pipe extending through said cover, a solenoid valve connected to said water inlet pipe and to said controller and situated outside of said tank, and a water inlet hose connected to said solenoid valve and connectable to said water source, said solenoid valve being selectively openable and closeable by said controller to respectively enable and disable said passage of said water from said water source into said tank.

17. The steam humidifier of claim 16, wherein said water inlet assembly further comprises an overflow valve, said overflow valve comprising an inlet pipe plug slidably and sealably mounted on a solenoid valve outlet of said solenoid valve extending into said water inlet pipe, and a compressive spring mounted on said solenoid valve outlet, said compressive spring holding said inlet pipe plug in sealing abutment with an external opening of said inlet pipe situated outside of said tank, said compressive spring being compressible by a water pressure exerted by said water against said pipe plug to move said pipe plug away from said external opening, thereby permitting an excess portion of said water to escape from said external opening.

18. The steam humidifier of claim 16, further comprising a water hammer absorber connected to said water hose in proximity to said solenoid valve, said water hammer absorber absorbing a shock wave generated by said solenoid valve upon opening and closing thereof.

19. The steam humidifier of claim 5, wherein said siphon drain assembly comprises an internal drain pipe and a water exhaust pipe, said internal drain pipe extending from said cover into said tank and having an O-ring seal mounted on a first end thereof and a water intake opening on a second end thereof, said water exhaust pipe extending from said cover outside of said tank to an outlet end of said water exhaust pipe, said first end of said internal drain pipe and said water exhaust pipe being releasably connected to one another through said cover with said O-ring sealingly abutting an inside wall of said cover, said internal drain pipe being thereby sealingly connected thereto, said water being received from said water inlet opening during siphoning thereof and siphoned through said internal drain pipe and said water exhaust pipe to said outlet end for disposal thereof.

20. The steam humidifier of claim 5, wherein said reservoir section comprises a reservoir floor and reservoir walls extending upwardly therefrom, said reservoir floor and said reservoir walls defining said reservoir section, and said siphon drain assembly comprises a water intake opening situated proximally adjacent said floor, between said floor and said heating element, said water being received into said siphon drain assembly, by siphoning thereof, from said tank through said water intake opening.

21. A steam humidifier comprising a tank having a reservoir section and a cover removably and sealingly secured thereto, said tank containing water during a humidifying operation in which the humidifier humidifies an indoor environment, said cover having a heating element mounted thereon and extending therefrom into said reservoir section and a steam outlet assembly mounted thereon and extending therethrough into said tank, said heating element evaporating at least a portion of said water during said humidifying operation into steam output through said steam outlet assembly to humidify said indoor environment, a housing within which said tank is housed, said cover being secured to said housing, wherein said housing comprises a rear mounting wall, a separating wall connected to the rear mounting wall and extending outwardly therefrom, and a removable bottom pan removably connected to at least one of said rear mounting wall and said separating wall, said removable bottom pan extending beneath said reservoir section when connected to said cover.

22. The steam humidifier of claim 21, wherein said removable bottom pan has a sloping floor wall with a drainage opening disposed thereon, said sloping floor wall sloping downwardly from said separating wall towards said drainage opening, wherein any additional water in said pan flows downwardly on said sloping flow wall into said drainage opening and is thereby drained from said pan.

23. The steam humidifier of claim 6, wherein said at least one rotor blade mounted on an axle connecting said rotor blade to said motor and upon which said blade is rotated thereby, said blade having edges disposed substantially perpendicular to said axle.

24. The steam humidifier of claim 3, further comprising a clamp mounting assembly for movably securing said V-clamp to said cover, said clamp mounting assembly including at least one clamp attachment, said clamp attachment including a pin member mounted on said cover and radially extending therefrom and a plate member mounted on said clamp and axially extending therefrom, said pin member radially slidably engaging a through hole of said plate member to locally allow at least radial displacement of said clamp relative to said cover.

25. The steam humidifier of claim 24, wherein said clamp attachment includes a biasing member urging said plate member radially away from said cover.

26. The steam humidifier of claim 25, wherein said biasing member is a compressive coil spring extending between said plate member and said cover.

27. The steam humidifier of claim 24, wherein said through hole is a slotted through hole extending in a generally circumferential direction.

* * * * *